US009551463B2

(12) United States Patent
Barnetson et al.

(10) Patent No.: US 9,551,463 B2
(45) Date of Patent: Jan. 24, 2017

(54) RETROFIT LED LIGHTING SYSTEM

(71) Applicant: Lunera Lighting Inc., Santa Clara, CA (US)

(72) Inventors: Don Barnetson, San Jose, CA (US); Daryl Cheim, San Jose, CA (US); John X. Zhang, Walnut Creek, CA (US); Ardeshir Esmaeili, San Jose, CA (US)

(73) Assignee: LUNERA LIGHTING INC., Santa Clara, CA (US)

( * ) Notice: Subject to any disclaimer, the term of this patent is extended or adjusted under 35 U.S.C. 154(b) by 0 days.

(21) Appl. No.: 14/859,368

(22) Filed: Sep. 21, 2015

(65) Prior Publication Data

US 2016/0010804 A1 Jan. 14, 2016

Related U.S. Application Data

(63) Continuation-in-part of application No. 14/715,171, filed on May 18, 2015, which is a continuation of application No. 13/969,613, filed on Aug. 19, 2013, now Pat. No. 9,033,545.

(51) Int. Cl.

| | |
|---|---|
| ***F21K 99/00*** | (2016.01) |
| *F21V 23/00* | (2015.01) |
| *F21Y 101/00* | (2016.01) |

(52) U.S. Cl.

CPC ..... *F21K 9/135* (2013.01); *F21K 9/232* (2016.08); *F21K 9/60* (2016.08); *F21V 23/003* (2013.01); *F21Y 2101/00* (2013.01)

(58) Field of Classification Search

CPC ..... F21K 9/135; F21K 9/232; F21K 9/60; F21V 23/003; F21V 2101/00

USPC ..... 362/249.02, 249.06, 650, 367

See application file for complete search history.

(56) References Cited

U.S. PATENT DOCUMENTS

| | | | | |
|---|---|---|---|---|
| 5,806,965 | A * | 9/1998 | Deese | H05B 33/0803 362/237 |
| 6,762,562 | B2 | 7/2004 | Leong | |
| 7,040,790 | B2 * | 5/2006 | Lodhie | B60Q 1/2607 362/249.05 |
| 7,852,017 | B1 | 12/2010 | Melanson | |
| 7,960,872 | B1 * | 6/2011 | Zhai | F21V 7/0008 307/151 |
| 8,545,052 | B2 * | 10/2013 | Hu | F21K 9/232 362/249.02 |

(Continued)

FOREIGN PATENT DOCUMENTS

WO 2009064099 A2 5/2009

*Primary Examiner* — Laura Tso

(74) *Attorney, Agent, or Firm* — Henry J. Cittone; Cittone & Chinta LLP

(57) ABSTRACT

A retrofit LED lighting system with a combination of a directional downlight component and an indirect uplight component is provided. The system comprises light emitting diodes arranged so as to replicate the function of a legacy light source in a transparent or translucent fixture housing. The LED lamp includes upwards facing LEDs emitting light upwards, and a translucent stem covering the uplight LEDs to allow the light from the LEDs to pass through it. Advantageously, the LED lamp with uplight component and a transparent/translucent stem allows the light to be directed upwards and hence, avoids having a sharp cut-off of light appearing in the middle of the reflector fixture and also avoids a lack of uplight shone on the ceiling.

7 Claims, 6 Drawing Sheets

(56) References Cited

U.S. PATENT DOCUMENTS

| | | | | |
|---|---|---|---|---|
| 8,814,381 | B2 * | 8/2014 | Ariyoshi | F21K 9/00 362/235 |
| 2006/0193131 | A1 | 8/2006 | McGrath et al. | |
| 2008/0130298 | A1 | 6/2008 | Negley et al. | |
| 2010/0277082 | A1 | 11/2010 | Reed et al. | |
| 2011/0043092 | A1 | 2/2011 | Shuja et al. | |
| 2012/0161666 | A1 | 6/2012 | Antony et al. | |
| 2012/0248477 | A1 | 10/2012 | Tischler et al. | |
| 2012/0300429 | A1 * | 11/2012 | Jin | F21V 7/22 362/84 |
| 2012/0314414 | A1 | 12/2012 | Flaherty et al. | |
| 2013/0010464 | A1 | 1/2013 | Shuja et al. | |
| 2014/0168977 | A1 * | 6/2014 | Hu | F21V 29/20 362/249.02 |
| 2014/0254151 | A1 * | 9/2014 | Kim | F21V 29/74 362/235 |

* cited by examiner

RETROFIT LED LIGHTING SYSTEM

RELATED APPLICATIONS

This application is a continuation-in-part of U.S. patent application Ser. No. 13/969,613, filed on Aug. 19, 2013, the disclosure of which is hereby incorporated by reference in its entirety.

FIELD OF THE INVENTION

The present invention relates to a lighting system, and more particularly to LED retrofit lighting systems for metal halide lamps.

BACKGROUND

A metal-halide lamp generates light by passing an electric arc through a gaseous mixture of vaporized mercury and metal halides. The metal halide lamps have high luminous efficiency and produce an intense white light. The metal halide lamps are used in wide area overhead lighting of commercial, industrial, and public spaces, such as parking lots, sports arenas, factories, and retail stores, as well as residential security lighting and automotive headlamps. Approximately 13% of US commercial space uses metal halide lamps for illumination purpose.

The metal halide lamp, though used widely, suffers from several disadvantages. A cold metal-halide lamp cannot immediately begin producing its full light capacity and requires approximately 5 minutes coming to full brightness. Furthermore if the power is interrupted, even briefly, the lamp's arc will extinguish, and the high pressure that exists in the hot arc tube will prevent re-striking the arc and therefore metal halide lamps must be allowed to cool for up to 20 minutes before they can be restarted.

In addition to having a moderate life span of approximately 10,000 hours and poor lumen maintenance, metal halide lamps are hazardous and risky to use. The metal halide lamps contain a significant amount of mercury and are prone to risk of explosion. Over a period of use, the arc tube gets weak, and since the gases are present at a significantly high pressure, chances for explosion of the metal halide lamps are always there.

The most recent evolution in lighting is solid state lighting based on light emitting diode (LED) technology. The light generation principle is similar to what happens in gas discharge lamps, but now the discharge happens in a solid state material: orbit changing electrons cause atoms to get 'excited' and to subsequently fall back to their ground state thereby releasing its surplus energy in the form of radiation. Advances in microelectronics technology have led light-emitting-diode (LED) technology to generate lighting and special purpose lighting applications. The LEDs have a large lifespan of 50,000 hrs and are RoHS compliant, i.e. they do not contain mercury or other toxic substances.

In view of the aforementioned disadvantages associated with the use of metal halide lamps and the technological advancement in LED technology, there is rising demand for replacing metal halide lamps with LED lamps. However the main concern for replacing metal halide lamp with LED lamp is the considerable labor costs involved in the installation, because it will require the opening of the light fixture to disassemble the existing ballast, whether it be an electronic one, or a magnetic one. Another concern involved in the replacement of metal halide lamps with LEDs is the lack of a recycle scheme for the ballast. Therefore in view of above constraints, it would be advantageous to have LED retrofit lamp that can directly replace the existing metal halide lamps.

BRIEF SUMMARY OF THE INVENTION

Existing acrylic or glass reflector HID fixtures with directional LED lamps deliver 100% of the light down and no light to the ceiling, creating a "cave effect". In a first aspect, the present invention provides a retrofit LED lamp that comprises a combination of a directional downlight component and an indirect uplight component in order to replicate the function of the legacy light source in transparent or translucent fixture housing. The uplight component preferably consists of uplight LEDs that emit light upwards, whereas the downlight component has directionally downlight LEDs. Further, the LED lamp of the present invention is installed within a transparent or translucent HID fixture. This allows for the light from the uplight LEDs to get refracted by the fixture and passed on towards the ceiling. Therefore, the retrofit LED lamp of such structure avoids a sharp cut-off of light in the middle of the reflector and a lack of uplight shone on the ceiling. In one embodiment, the uplight component involves addition of an uplight printed circuit board and a transparent or translucent stem for passing the light through. In another embodiment, the LED lamp involves addition of upward facing LEDs to a controller board, in addition to the downlight LEDs. The effect of the uplight board is to move a portion of the light, for example 10% of the lumens, to the indirect lighting component.

In another aspect, the present invention provides a LED retrofit lamp comprising: a lamp housing having an array of light emitting diodes, said array of light emitting diodes comprising at least one uplight LED, and a second array of light-emitting diodes comprising at least one downlight LED; a diffuser coupled to a distal end of the lamp housing to allow light emitted by said at least one downlight LED to pass through; and a stem coupled to a proximal end of the lamp housing to allow light from said at least one uplight LEDs to pass through it. The shape of the lamp housing can be circular, semi-circular, cylindrical rectangular, parabolical or square shaped and is made of a transparent or translucent material. The stem is made of materials selected from the group consisting of glass, acrylic or other transparent or translucent material. The LED retrofit lamp is configured to be operable on outputs coming from a magnetic ballast, a fluorescent ballast or a direct AC source.

BRIEF DESCRIPTION OF THE DRAWINGS

The preferred embodiment of the invention will hereinafter be described in conjunction with the appended drawings provided to illustrate and not to limit the scope of the invention, wherein like designation denote like element and in which.

DETAILED DESCRIPTION OF THE EMBODIMENTS

In the following detailed description of embodiments of the invention, numerous specific details are set forth in order to provide a thorough understanding of the embodiment of invention. However, it will be obvious to a person skilled in art that the embodiments of invention may be practiced with or without these specific details. In other instances well known methods, procedures and components have not been described in detail so as to not unnecessarily obscure aspects of the embodiments of the invention.

Furthermore, it will be clear that the invention is not limited to these embodiments only. Numerous modifications, changes, variations, substitutions and equivalents will be apparent to those skilled in the art, without parting from the spirit and scope of the invention.

The present invention provides a retrofit LED lamp that provides a replacement for a metal halide lamp driven by a magnetic ballast. The circuit of the retrofit LED lamp comprises a bridge rectifier that converts the AC waveform of the magnetic ballast to a single sided waveform to generate DC output that is fed to LED. The frequency of waveform generated by a magnetic ballast is low, therefore a traditional rectifier is sufficient to provide the desired DC output required for illumination of LEDs.

The retrofit lamp is a LED lamp that provides a replacement for an existing metal halide lamp driven by the magnetic ballast. The retrofit lamp works on the electric current supplied by the magnetic ballast, hence it can directly replace the existing metal halide lamp without removing the existing ballast.

Figure 1:
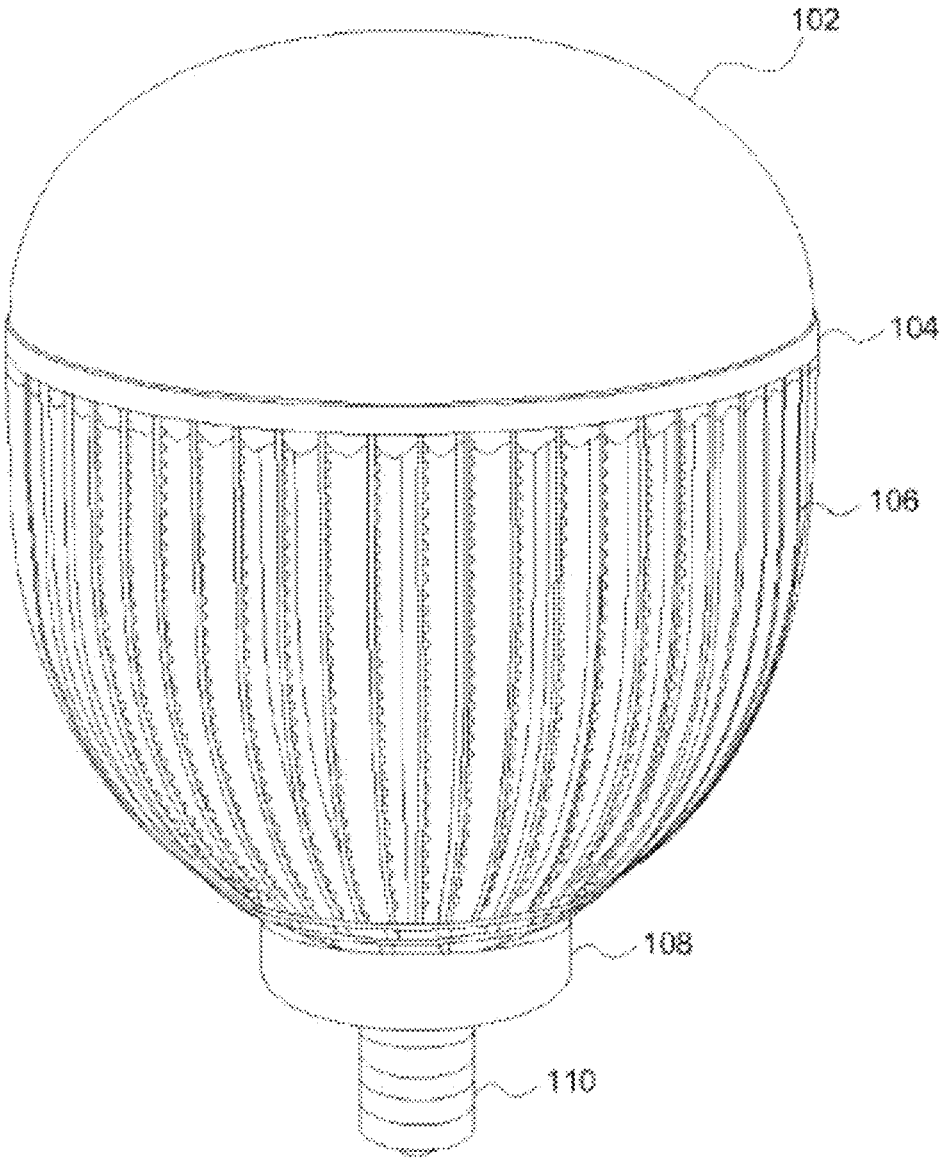
FIG. 1 illustrates a retrofit LED lamp for replacement of a metal halide lamp driven by a magnetic ballast, in accordance with an embodiment of the present invention.

FIG. 1 illustrates a retrofit LED lamp for replacement of a metal halide lamp driven by a magnetic ballast, in accordance with an embodiment of the present invention. Referring to FIG. 1, the retrofit lamp includes a plurality of LEDs mounted on a MCPCB plate 104 which is placed in a housing 106 that keeps the plurality of LEDs in a fixed position. The housing 106 can be circular, semi-circular, cylindrical, rectangular, parabolical or a square housing typically used with lamps. The housing 106 provides a heat sink for the LEDs by providing a path for heat from the LED source to the outside medium. The thermal conductivity of the material of the housing 106 directly effects dissipation of heat through conduction. The housing 106 can be made, for example, of aluminum or copper or thermoplastic material or a natural graphite or graphite composite that offers better thermal transfer than copper with a lower weight than aluminum. The heat sink made of natural graphite composite has the ability to be formed into complex two dimensional shapes. The housing 106 is covered with a diffuser 102 to transmit the light generated by the plurality of LEDs to outside. At the end of housing 106, a ring plate 108 is attached that contains the circuit for converting the AC input from magnetic ballast to DC waveform. A base connector 110 is provided at the bottom of ring plate 108 for fitting the retrofit lamp into the socket.

In an embodiment of the present invention, a plurality of LEDs are arranged on a MCPCB (Metal Core PCB) plate 104. The MCPCB 104 incorporates a base metal material as heat spreader as an integral part of the circuit board. The base metal material can be aluminum alloy or alternatively it may incorporate a dielectric polymer layer with high thermal conductivity for lower thermal resistance. The plurality of LEDs is arranged on the MCPCB plate 104 such that the output angle of the emitted light is substantially perpendicular to the surface of MCPCB plate 104. The MCPCB plate 104 is preferably mounted on the housing 106 via a mechanical connector, such as a clip or screw. The housing 106 is preferably adapted for dissipation of excess heat generated by the lighting of LEDs. The housing 106 acts as a heat sink for the retrofit lamp assembly. The housing 106 is preferably fabricated from aluminum, though it can also be fabricated from or incorporate other materials having high thermal conductivity, including but not limited to copper, natural graphite or a thermoplastic material. Further, the housing 106 is preferably designed to have a large surface area for maximum heat dissipation, for example the housing 106 may be provided with a number of fins. The diffuser 102 is mounted on the housing 106 through a mechanical connector, such as a screw or clip, for diffusing the light emitted by the LEDs. The diffuser 102 is made of glass or an equivalent transparent or translucent material fabricated in a shape such that the light emitted by the LED is released by the diffuser 102 effectively.

In an embodiment of the present invention, the retrofit lamp may have a curved diffuser 102. Based on the surface area of the light-emitting surface of the panel, the size and thickness of the optimum light diffuser may be determined. The suitable diffuser 102 may be made from a composite material of polymer and glass fiber, or from a polycarbonate/acrylic material. These materials may be designed with varying amounts of hardness and light refractory characteristics. A sufficient hardness and thickness are required for the structural integrity of the overall panel and refractory characteristics, which are also related to the thickness, and are selected in order to cause the light to be transmitted evenly across the diffuser 102. Another advantage of using a sufficiently thick diffuser is that it prevents the LED sources from being visible, thereby increasing the aesthetic value and preventing the fixture from causing objects to cast multiple shadows.

The ring plate 108 is provided at the end of housing 106 such that the ring plate 108 seals the bottom end of the housing 106. A PCB mounted on the ring plate 108 comprises a circuit for converting the AC waveform received from the ballast to a DC voltage suitable for driving the LEDs. The PCB circuit gets AC input power from the base connector 110. The base connector 110 fits into the socket meant for a metal halide lamp and receives the AC input waveform from the magnetic ballast.

Figure 2A:
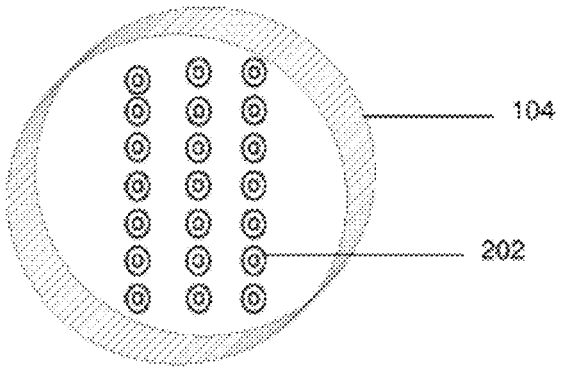
FIG. 2A illustrates a schematic representation of an array of LEDs arranged on a MCPCB plate in accordance with an embodiment of the present invention.
Figure 2B:
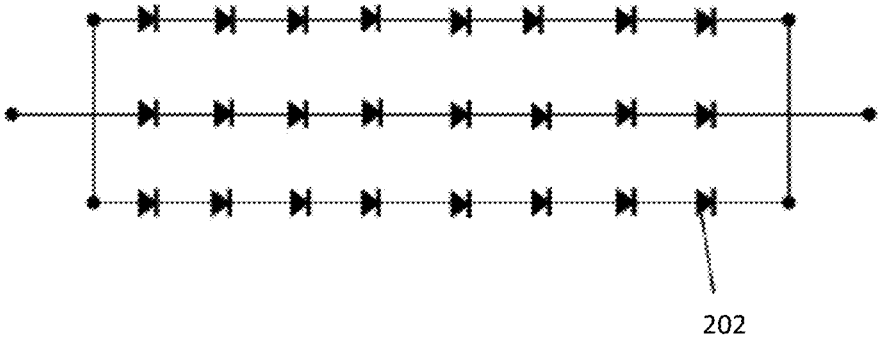
FIG. 2B is a schematic representation LEDs connected in a series to the output of a PCB circuit.

FIGS. 2A and 2B are schematic mechanical and electrical representations of an array of LEDs arranged on a MCPCB plate in accordance with one embodiment of the present invention. Referring to FIG. 2A, the MCPCB plate 104 is mounted with a plurality of LEDs 202 arranged in a rectilinear fashion. The plurality of LEDs 202 is arranged on the MCPCB plate in such a manner that the output angle of the light is substantially perpendicular to the MCPCB plate. Since the diffuser 102 is fitted over the MCPCB plate 104 with its horizontal axis parallel to the MCPCB plate 104, the light emitted by the plurality of LEDs 202 will pass directly through the exit aperture of the light fixture. This makes the retrofit lamp a directional emitter, and over 80 percent of the light is emitted directly from the fixture and only a small amount of the light is emitted towards the surface of the fixture. The light emitted towards the surface will then be reflected from the surface coated with reflector. The characteristic feature of the retrofit lamp, the lamp emitting light directly from the exit aperture makes the optical efficiency of the retrofit lamp greater than 80 percent. The conventional downlight lamps are only 50 percent optical efficient as the downlight metal halide lamp is omni-directional emitter and only a small portion of light is emitted directly from the exit aperture, and a large portion of light is emitted after reflection from the lamp surface. FIG. 2B shows a plurality of LEDS 202 connected in a series to the output of PCB circuit.

Figure 3:
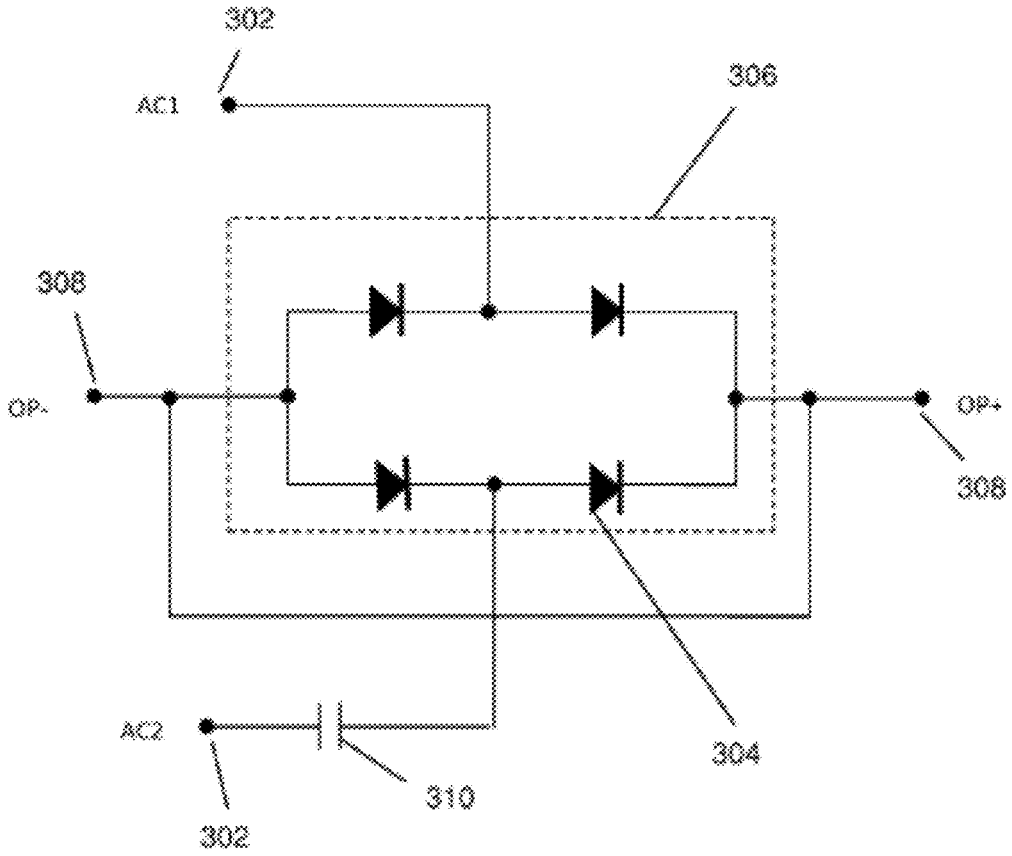
FIG. 3 shows the schematic illustration of the PCB used in LED retrofit lamp, in accordance with an embodiment of the present invention.

FIG. 3 shows the schematic illustration of the PCB used in LED retrofit lamp, in accordance with an embodiment of the present invention. Referring FIG. 3, the output 302 from the magnetic ballast serves as an input to the PCB circuit. The input is then fed into a bridge rectifier 306 that converts the AC waveform of the magnetic ballast to a single sided waveform output at 308. The bridge rectifier 306 is made of four diodes 304 arranged in a bridge manner. A capacitor 310 may be placed at the input to the bridge rectifier 306. The capacitor 310 reduces the compensation capacitance and helps in bringing the power factor close to 1.

In an embodiment of the present invention the capacitor 310 may be damped with a series resistor to reduce harmonic distortion.

In another embodiment of the present invention, an inductor can be placed after the bridge rectifier 306 to reduce the current crest factor of the waveform presented to the LED 202.

Figure 4:
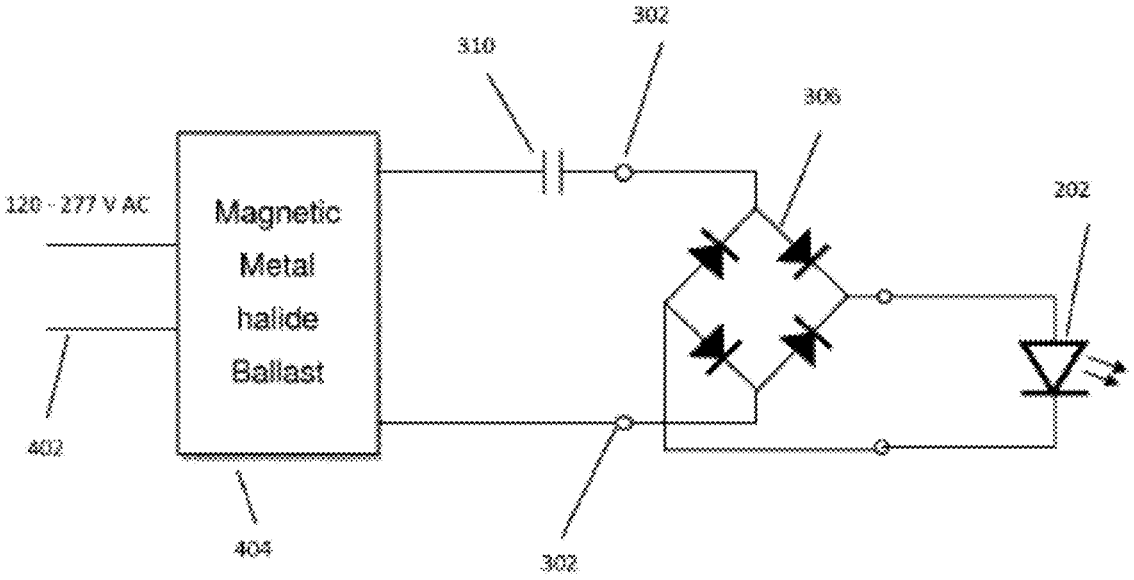
FIG. 4 illustrates a circuit diagram of a retrofit LED lamp driven by a magnetic ballast, in accordance with an embodiment of the present invention.

FIG. 4 illustrates a circuit diagram of a retrofit LED lamp driven by a magnetic ballast, in accordance with an embodiment of the present invention. The AC main supply 402 is supplied as an input to the magnetic metal halide ballast 404. The output from the magnetic metal halide ballast 404 is then fed as an input to a bridge rectifier 306 that converts the AC waveform 302 generated by the magnetic ballast 404 to a single sided waveform. The capacitor 310 is placed in line with the output from the magnetic metal halide ballast 404.

Figure 5:
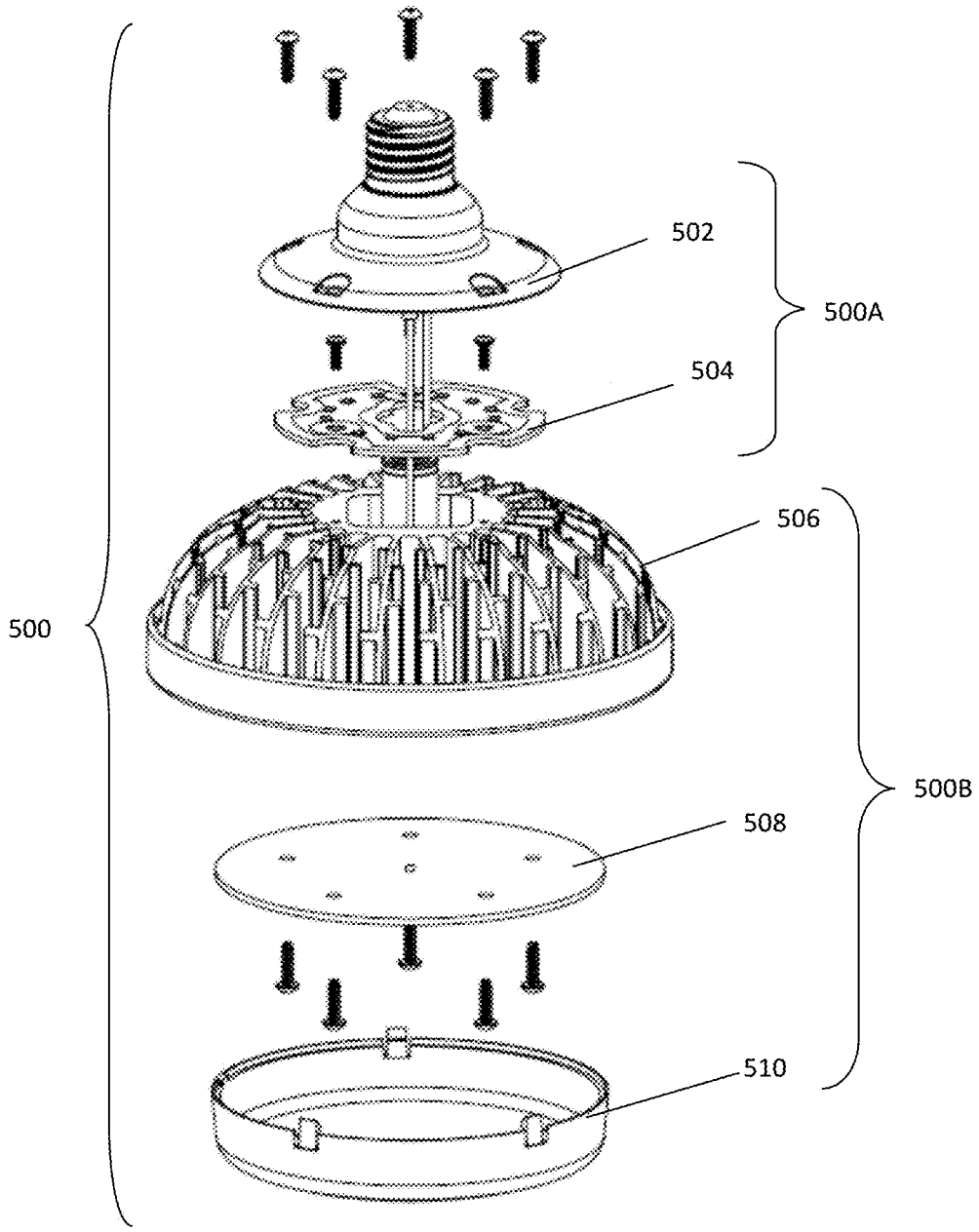
FIG. 5 illustrates an exploded view of a retrofit LED lamp, in accordance with an embodiment of the present invention.

FIG. 5 illustrates an exploded view of a retrofit LED lamp, in accordance with an embodiment of the present invention. The LED retrofit lamp comprises a directional downlight component 500B and an uplight component 500A in order to replicate the function of the legacy light source in transparent or translucent fixture housing. The directional downlight component 500B of the retrofit LED lamp includes an array of a plurality of LEDs mounted on a printed circuit board (PCB) 508 and is placed in a housing 506 that keeps the array of LEDs in a fixed position. The housing 506 can be circular, semi-circular, cylindrical, rectangular, parabolical or a square housing typically used with lamps. The housing 506 provides a heat sink for the LEDs by providing a path for heat from the LED source to the outside medium. The thermal conductivity of the material of the housing 506 directly affects dissipation of heat through conduction. The housing 506 can be made of one or more of aluminum or copper or thermoplastic material or a natural graphite solution that offers better thermal transfer than copper with a lower weight than aluminum. The downlight component 500B of the lamp delivers light emitted from the downlight LEDs installed at the PCB 508 in a downwards direction owing to its structure. A diffuser 510 is mounted on the housing 506 for diffusing the light emitted by LEDs. The diffuser 510 is made of a transparent or a translucent material and fabricated in a shape such that the light emitted by the LEDs is released by the diffuser 510 effectively.

The uplight component 500A of the LED retrofit lamp comprises a second LED array mounted in upright orientation to direct light upwards towards a ceiling. The uplight LED array may be mounted on an upper printed circuit board (PCB) 504. The uplight LEDs on the uplight component 500A are intentionally faced upwards and preferably deliver a sufficient amount of light to replicate the look of a HiD source. In the illustrated embodiment, the LED array of the uplight component 500A is mounted on an upper PCB 504 and is enveloped by an uplight transparent or translucent stem 502. The stem may be made of glass or acrylic material that is transparent or translucent, allowing the light emitted from the uplight LED array to pass through and reach the ceiling. In this embodiment, the effect of uplight component 500A is to deliver about 10%-15% of the total output lumens to the indirect lighting component. Therefore, the LED retrofit lamp 500 provides, in a single unit, a combination of directional downlight component 500B and an indirect uplight component 500B in order to replicate the function of the legacy light source in a transparent or translucent fixture housing.

Figure 6:
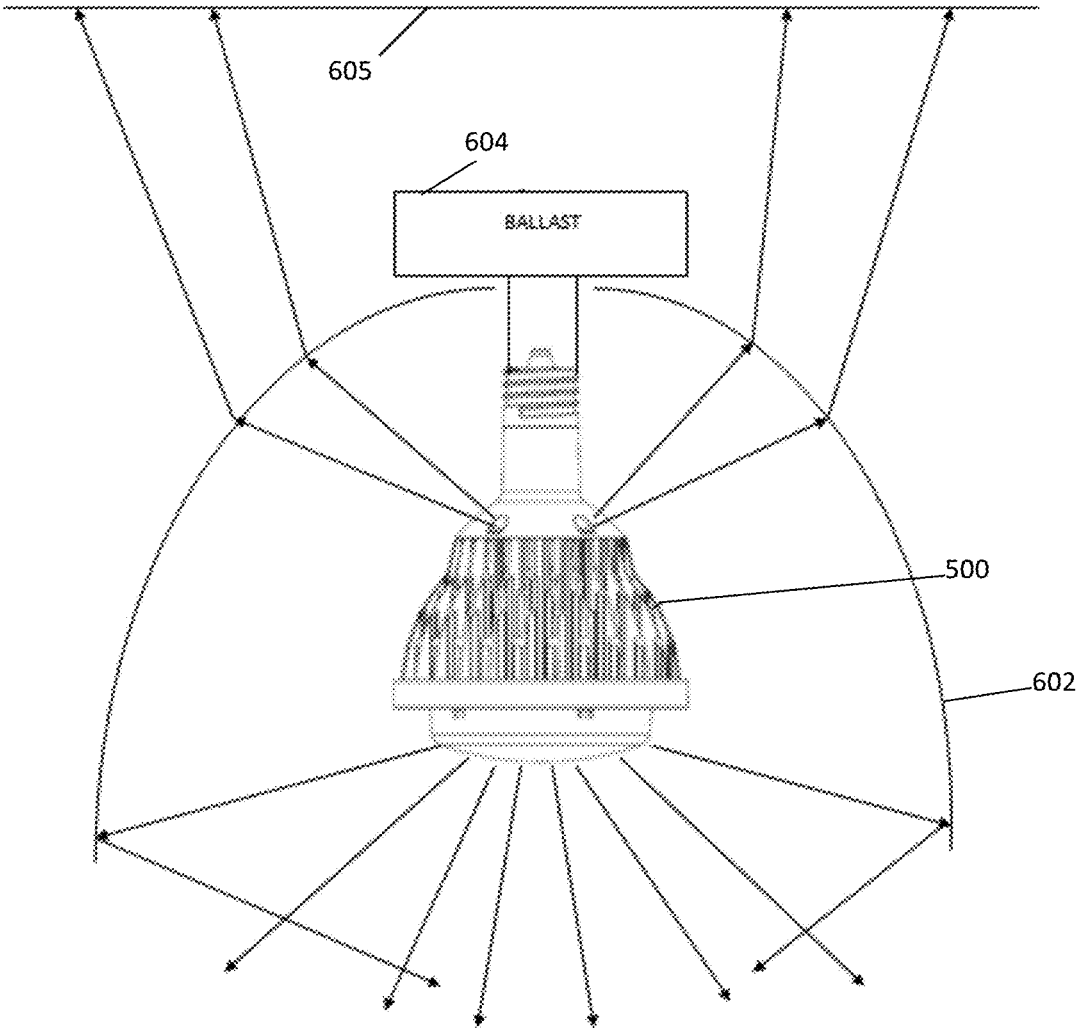
FIG. 6 illustrates illumination area of the LED retrofit lamp 500, in accordance with an embodiment of the present invention.

FIG. 6 illustrates illumination area of the LED retrofit lamp 500, in accordance with an embodiment of the present invention. The LED retrofit lamp has a downlight and an uplight components, installed within a transparent or translucent fixture 602 and is driven by an external ballast 604. Most of the light (represented by arrows) is directed downwards toward the floor because of the light emitted by the directional downlight component. Further, due to the uplight component of the LED lamp 500 a portion of the light is directed upwards towards the ceiling 605. The light emitted from the uplight component passes through the transparent uplight stem and is refracted by the fixture 602 to reach the ceiling. Therefore, a sharp cut-off of light in the middle of the refractor/reflector and a lack of uplight shone on the ceiling is avoided.

The structure, which is the combination of directional downlight component 500B and the indirect uplight component 500B, avoids the occurrence of "cave effect" and ensures maximum efficacy by driving a large portion of light, for example 85%-90% of the light, downwards without a lossy reflection/refraction.

The transparent/translucent fixture may be made at least party of glass or acrylic material that is transparent or translucent in nature in order to permit light to pass through it.

In one embodiment, the uplight component 500A may have additional separate LEDs facing upwards and mounted on the uplight PCB 504. In another embodiment, the downlight component 500B involves addition of intentionally upward facing LED to a controller board.

In an embodiment, the PCB 504 may be a metal core printed circuit board (MCPCB).

Advantageously, the present invention provides an LED lamp that avoids the occurrence of "cave effect" and ensures maximum efficacy by driving a large portion of light, for example 85%-90% of the light downwards without a lossy reflection/refraction.

We claim:

1. A LED retrofit lamp, comprising:

a lamp housing having a first array of light emitting diodes, said first array comprising at least one downlight LED, and a second array of light emitting diodes, said second array comprising at least one uplight LED;

a diffuser coupled to a distal end of the lamp housing to allow light emitted by said at least one downlight LED to pass through; and a stem coupled to a proximal end of the lamp housing to allow light from said at least one uplight LEDs to pass through it.

2. The LED retrofit lamp of claim 1 wherein the lamp housing is made of a transparent or a translucent material.

3. The LED retrofit lamp of claim 1, wherein the stem is made of a transparent material or a translucent material.

4. The LED retrofit lamp of claim 3, wherein the stem is made of glass or acrylic.

5. The LED retrofit lamp of claim 1, wherein the lamp housing is circular, semi-circular, cylindrical, rectangular, parabolical or square shaped.

6. The LED retrofit lamp of claim 1, wherein the LED retrofit lamp is configured to operable on a magnetic ballast, a fluorescent ballast or a direct AC source.

7. The LED retrofit lamp of claim 6, wherein the LED retrofit lamp is configured to operable on a magnetic ballast.

* * * * *